US011536157B2

(12) United States Patent
Joly et al.

(10) Patent No.: US 11,536,157 B2
(45) Date of Patent: Dec. 27, 2022

(54) DAMPING DEVICE

(71) Applicant: SAFRAN AIRCRAFT ENGINES, Paris (FR)

(72) Inventors: Philippe Gérard Edmond Joly, Moissy-Cramayel (FR); François Jean Comin, Moissy-Cramayel (FR); Charles Jean-Pierre Douguet, Moissy-Cramayel (FR); Laurent Jablonski, Moissy-Cramayel (FR); Romain Nicolas LaGarde, Moissy-Cramayel (FR); Jean-Marc Claude Perrollaz, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 310 days.

(21) Appl. No.: 16/955,518

(22) PCT Filed: Dec. 18, 2018

(86) PCT No.: PCT/FR2018/053375
§ 371 (c)(1),
(2) Date: Jun. 18, 2020

(87) PCT Pub. No.: WO2019/122691
PCT Pub. Date: Jun. 27, 2019

(65) Prior Publication Data

US 2021/0010391 A1 Jan. 14, 2021

(30) Foreign Application Priority Data

Dec. 18, 2017 (FR) ..... 1762358
Dec. 19, 2017 (FR) ..... 1762545

(51) Int. Cl.
*F01D 25/04* (2006.01)

(52) U.S. Cl.
CPC ..... *F01D 25/04* (2013.01); *F05D 2220/30* (2013.01); *F05D 2220/36* (2013.01); *F05D 2230/60* (2013.01); *F05D 2260/96* (2013.01)

(58) Field of Classification Search
CPC ..... F01D 25/04; F01D 25/06; F05D 2220/30; F05D 2220/36; F05D 2230/60; F05D 2260/96
See application file for complete search history.

(56) References Cited

U.S. PATENT DOCUMENTS 2,999,668 A 9/1961 Howald et al.
4,192,633 A * 3/1980 Herzner ..... F01D 11/006 416/193 A (Continued)

FOREIGN PATENT DOCUMENTS

EP 2009238 A1 12/2008
FR 2888876 A1 1/2007

(Continued)

OTHER PUBLICATIONS

French Search Report in French Application No. 1762358, dated Jul. 31, 2018.

(Continued)

*Primary Examiner* — Courtney D Heinle
*Assistant Examiner* — Danielle M. Christensen
(74) *Attorney, Agent, or Firm* — Sughrue Mion, PLLC

(57) ABSTRACT

The invention relates to an assembly (1) for a turbomachine comprising:

Figure 1:
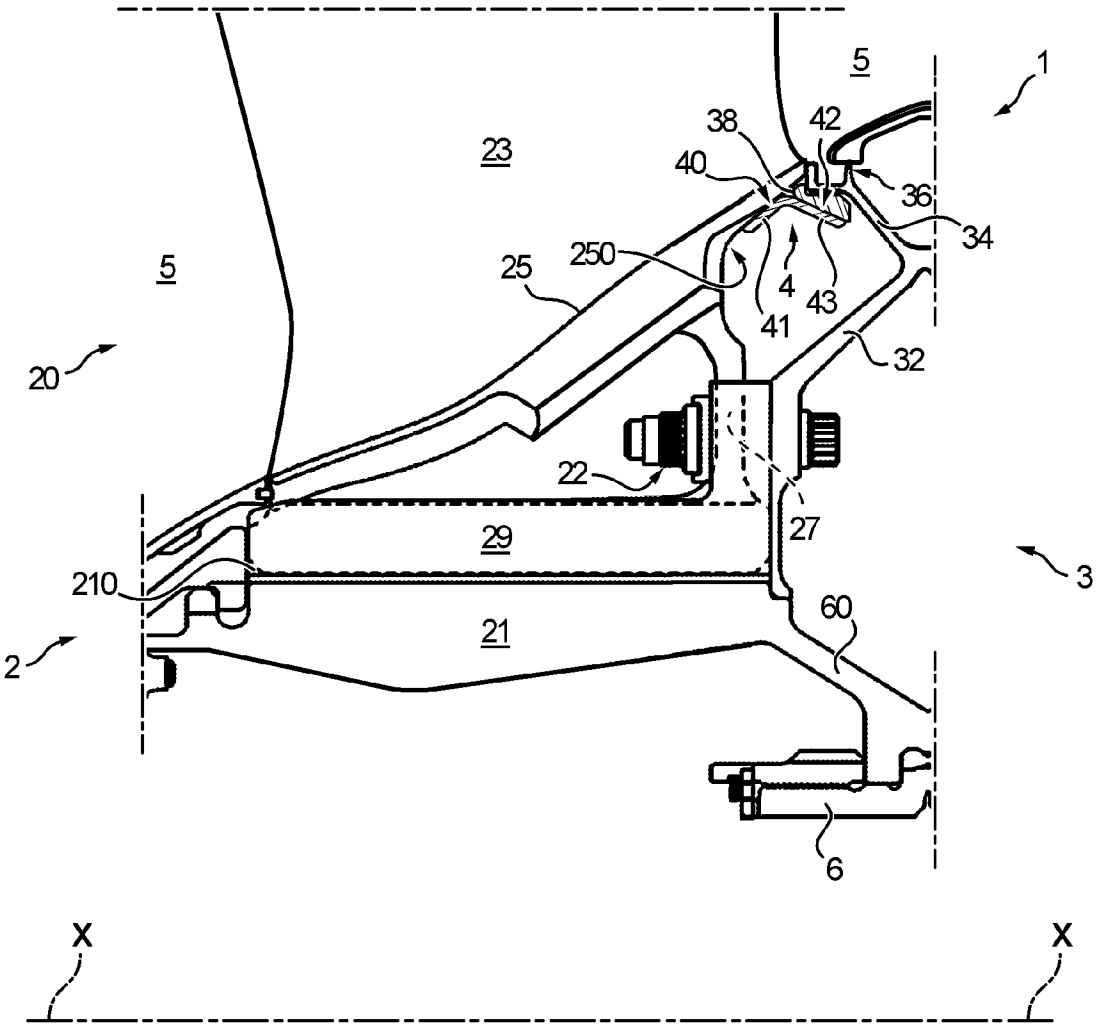

a first rotor module (2) comprising a first blade (20), a second rotor module (3), connected to the first rotor module (2), and comprising a second blade with a length less than the first blade (20), and a damping device (4) extending with at least one component along a turbomachine longitudinal axis (X-X), (Continued)

characterized in that the damping device (4) is annular while extending circumferentially around the turbomachine longitudinal axis (X-X) and in that the damping device (4) comprises a first radial external surface (40) supported with friction against the first module (2) as well as a second radial external surface (42) supported with friction against the second module (3), so as to couple the modules (2, 3) in order to damp their respective vibrational movements during operation.

11 Claims, 7 Drawing Sheets

(56) References Cited

U.S. PATENT DOCUMENTS

| | | | | |
|---|---|---|---|---|
| 4,723,889 | A | 2/1988 | Charreron et al. | |
| 5,205,713 | A | 4/1993 | Szpunar et al. | |
| 2009/0104036 | A1* | 4/2009 | Fabre | F01D 5/3007 416/185 |
| 2011/0171018 | A1* | 7/2011 | Garcia-Crespo | F01D 9/042 415/208.2 |
| 2017/0167264 | A1 | 6/2017 | Sicard et al. | |
| 2017/0226861 | A1 | 8/2017 | Evain et al. | |
| 2017/0234133 | A1* | 8/2017 | Prescott | F04D 29/321 416/1 |

FOREIGN PATENT DOCUMENTS

| | | | |
|---|---|---|---|
| FR | 3047512 | A1 | 8/2017 |
| GB | 670665 | A | 4/1952 |

OTHER PUBLICATIONS

International Search Report in International Application No. PCT/FR2018/053375 dated Feb. 26, 2020.
French Search Report in French Application No. 1762545, dated Aug. 6, 2018.

* cited by examiner

DAMPING DEVICE

CROSS REFERENCE TO RELATED APPLICATIONS

This application is a National Stage of International Application No. PCT/FR2018/053375 filed Dec. 18, 2018, claiming priority based on French Patent Application No. 1762358, filed Dec. 18, 2017 and French Patent Application No. 1762545 filed Dec. 19, 2017, the entire contents of each of which are herein incorporate by reference in their entireties.

TECHNICAL FIELD

The invention relates to an assembly comprising a turbomachine rotor module.

The invention relates more specifically to an assembly for a turbomachine comprising two rotor modules and a damping device.

PRIOR ART

A turbomachine rotor module generally comprises one or more stage(s), each stage comprising a disk centered on a turbomachine longitudinal axis, corresponding to the axis of rotation of the rotor module. The rotation of the disk is generally ensured by a rotating shaft to which it is integrally connected, for example by means of a rotor module trunnion, the rotating shaft extending along the turbomachine longitudinal axis. Blades are mounted on the external periphery of the disk, and distributed circumferentially in a regular manner around the longitudinal axis. Each blade extends from the disk, and further comprises an airfoil, a platform, a support and a root. The root is embedded in a recess of the disk configured for this purpose, the airfoil is swept by a flow passing through the turbomachine and the platform forms a portion of the internal surface of the flow path.

The operating range of a rotor module is limited, in particular due to aeroelastic phenomena. The rotor modules of modern turbomachines, which have a high aerodynamic loading and a reduced number of blades, are more sensitive to this type of phenomena. In particular, they have reduced margins between the operating zones without instability and the unstable zones. It is nevertheless imperative to guarantee a sufficient margin between the stability range and that of instability, or to demonstrate that the rotor module can operate in the unstable zone without exceeding its endurance limit. This allows guaranteeing risk-free operation over its entire life and the entire range of operation of the turbomachine.

Operation in the zone of instability is characterized by coupling between the fluid and the structure, the fluid applying the energy to the structure, and the structure responding with its natural modes at levels which can exceed the endurance limit of the material constituting the blade. This generates vibrational instabilities which accelerate the wear of the rotor module and reduce its lifetime.

In order to limit these phenomena, it is known to implement a system damping the dynamic response of the blade, so as to guarantee that it does not exceed the endurance limit of the material, regardless of the operating point of the rotor module. However, most of the known systems of the prior art are dedicated to damp vibration modes with non-zero dephasing, and characterizing an asynchronous response of the blades to aerodynamic forces. Such systems have for example been described in documents FR 2 949 142, EP 1 985 810 and FR 2 923 557, in the Applicant's name. These systems are all configured to be accommodated between the platform and the root of each blade, in the recess delimited by the respective supports of two successive blades. Moreover, such systems operate, when two successive blade platforms are moved with respect to one another, by dissipating the vibration energy, by friction for example.

However, these systems are completely ineffective for damping vibration modes having a zero-dephasing involving the blades and the rotor line, i.e. its rotating shaft. Such modes are characterized by a flexure of the rotor blades with zero inter-blade dephasing implying a non-zero moment on the rotating shaft. In addition, this is a coupled mode between the blade, the disk and the rotating shaft. More precisely, the torsion within the rotor module, resulting for example from reverse forces between a turbine rotor and a compressor rotor, lead to flexural movements of the blades with respect to their attachment to the disk. These movements are greater the longer the blade, and the more the attachment is flexible.

Thus, there exists a need for a damping system for a turbomachine rotor making it possible to limit the instabilities generated by all modes of vibration as previously described.

SUMMARY OF THE INVENTION

One object of the invention is to dampen vibration modes with zero dephasing for all types of turbomachine rotor modules.

Another object of the invention is to influence the damping of vibration modes with non-zero dephasing, for all types of turbomachine rotor modules.

Another object of the invention is to propose a damping solution that is simple and easy to implement.

The invention proposes in particular a turbomachine assembly comprising:

- a first rotor module comprising a first blade,
- a second rotor module, connected to the first rotor module, and comprising a second blade of smaller length than the first blade, and
- a damping device extending for at least one component along a turbomachine longitudinal axis characterized in that the damping device is annular while extending circumferentially around the turbomachine longitudinal axis, and in that the damping device comprises a first radial external surface supported with friction against the first module, as well as a second radial external surface supported with friction against the second module, so as to couple the modules in order to damp their respective vibrational movements during operation.

The mechanical coupling between the first and the second rotor module allows increasing the tangential stiffness of the connection between these two rotors, while still allowing a certain axial and radial flexibility of the damping device so as to maximize contact between the different elements of the assembly. This makes it possible to limit the instabilities related to the vibration mode with zero dephasing, but also to participate in the damping of vibration modes with non-zero dephasing. In addition, such an assembly has the advantage of an easy integration within existing turbomachines, whether during manufacture or during maintenance. In fact, the annular nature of the damping device allows reducing its bulk between the two engine modules.

The assembly according to the invention can further comprise the following features, taken alone or in combination:

- the damping device is an annular tab, the cross section of which is shaped like a V, one external surface of a first branch of the V forming the first radial external surface supported with friction against the first rotor module, one external surface of a second branch of the V forming the second radial external surface supported with friction against the second rotor module,
- in this assembly:
  - the first rotor module comprises a disk centered on the turbomachine longitudinal axis, the first blade being mounted on the external periphery of the disk from which it extends, and further comprising an airfoil, a platform, a support and a root embedded in the recess of the disk, and
  - the second module comprises a ferrule comprising a circumferential extension extending toward the platform of the first blade,
- the first radial external surface of the damping device being supported with friction on a radially internal surface of the platform of the first blade, the second radial external surface of the damping device being supported with friction on the ferrule,
- an attachment ferrule is shrink-fit to the circumferential extension, the second radial external surface of the damping device being supported with friction on the attachment ferrule,
- the extension bears radial sealing lips, the second radial external surface of the damping device being supported with friction on the sealing lips,
- the support surfaces of the damping device and the surfaces of the platform and the radial sealing lips are treated, with a carbon-carbon deposit for example, so as to guarantee their respective supports,
- the damping device comprises a coating of the dissipative type, defining the support surfaces,
- the damping device comprises a coating of the viscoelastic type,
- the damping device comprises bores intended to lighten the damping device,
- the damping device comprises inserts, of the metallic type for example, intended to add weight to the damping device,
- the first module is a fan, and the second module is a compressor, for example a low-pressure compressor, and
- the damping device is split so as to define two ends facing one another.

The invention also relates to a turbomachine comprising an assembly as previously described.

The invention further relates to an annular damping device extending circumferentially around a turbomachine longitudinal axis, and comprising a first radial external surface configured to be supported with friction against a first rotor module as well as a second radial external surface configured to be supported with friction against a second rotor module of an assembly as previously described, so as to couple the modules in order to damp their respective vibrational movements during operation.

Finally, the invention relates to a method for assembling an assembly as previously described, comprising the steps of:

- arranging the damping device between the first rotor module and the second rotor module so that the first radial external surface of the damping device is supported with friction against the first module, and the second radial external surface of the damping device is supported with friction against the second module, and
- preloading the damping device against the modules, so as to couple them in order to damp their respective vibrational movements during operation.

RAPID DESCRIPTION OF THE FIGURES

Figure 2:
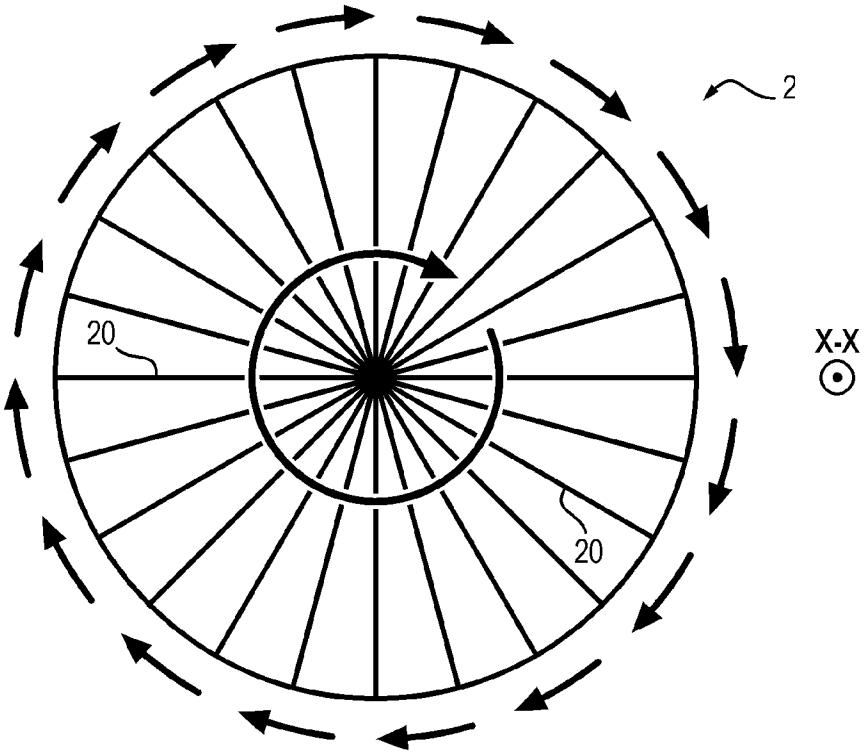
Figure 3A:
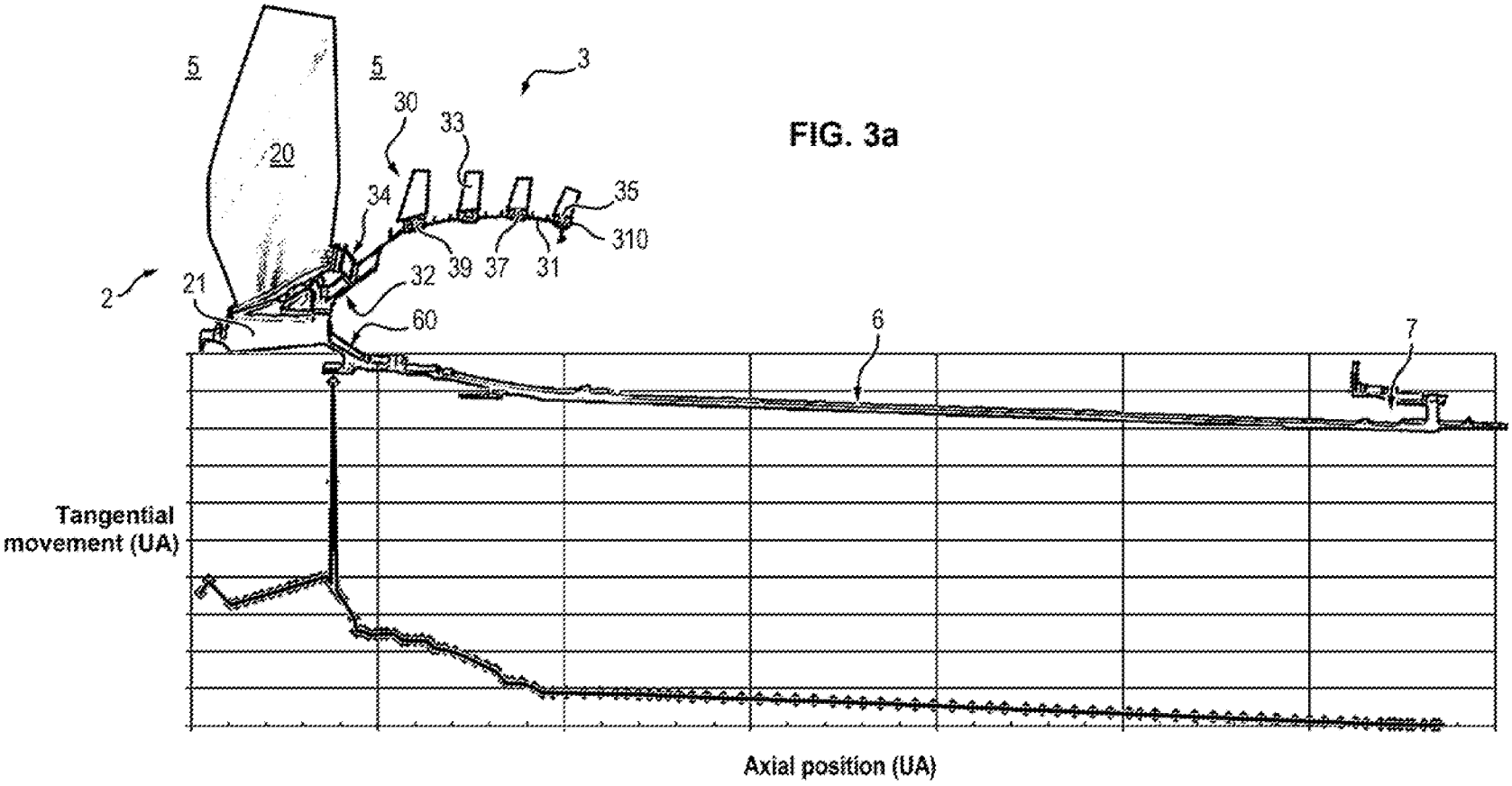
Figure 3B:
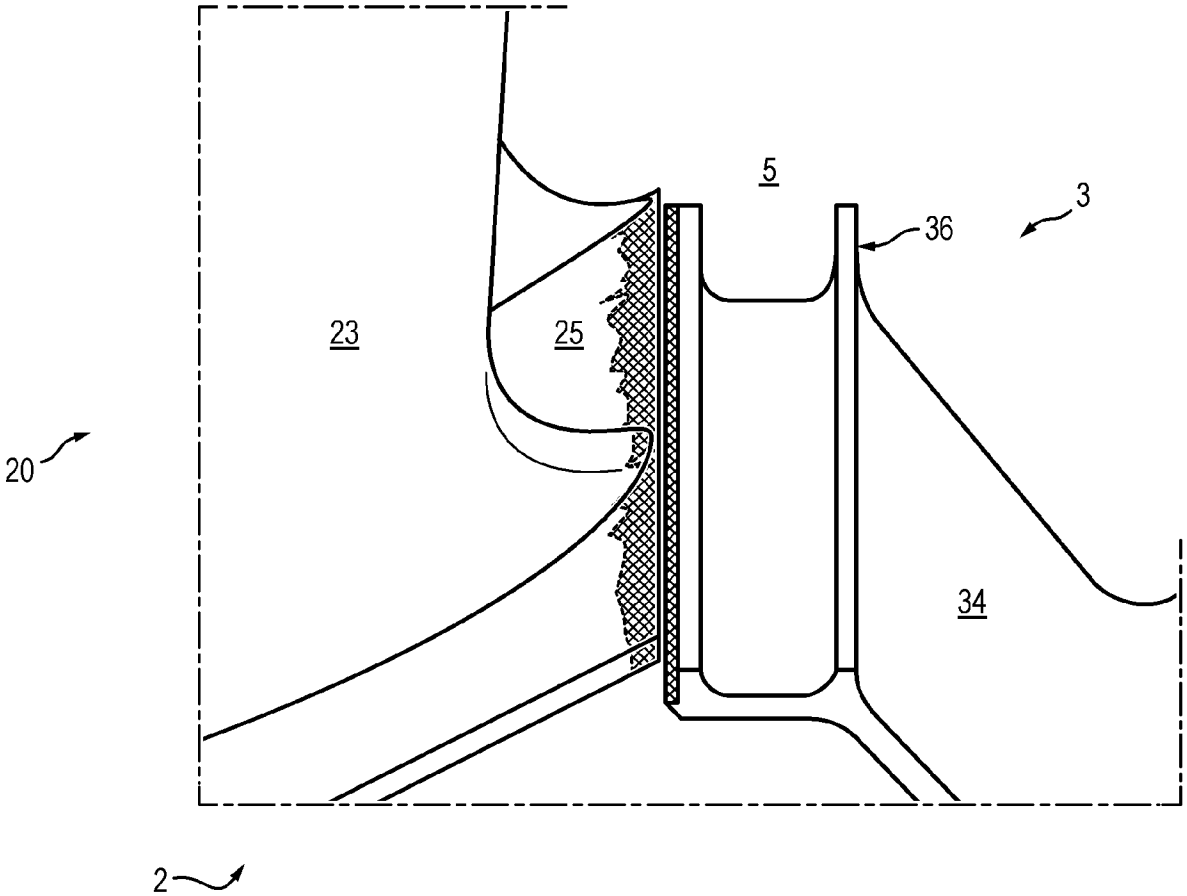
Figure 4:
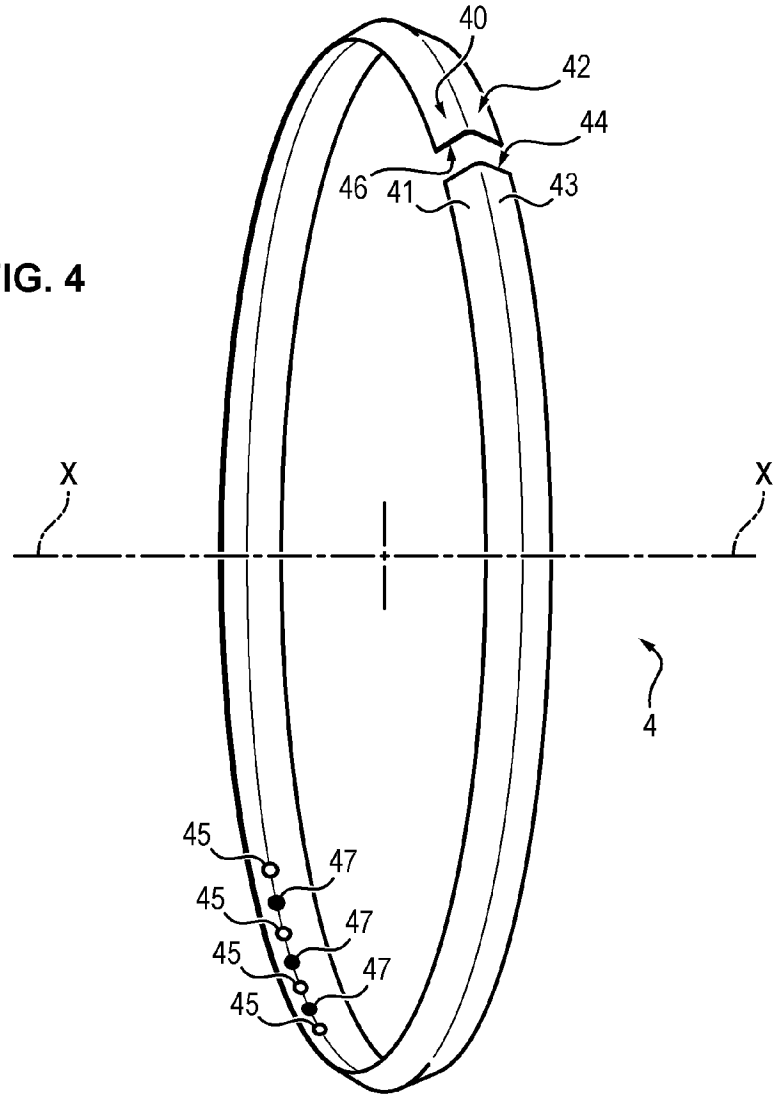
Figure 5:
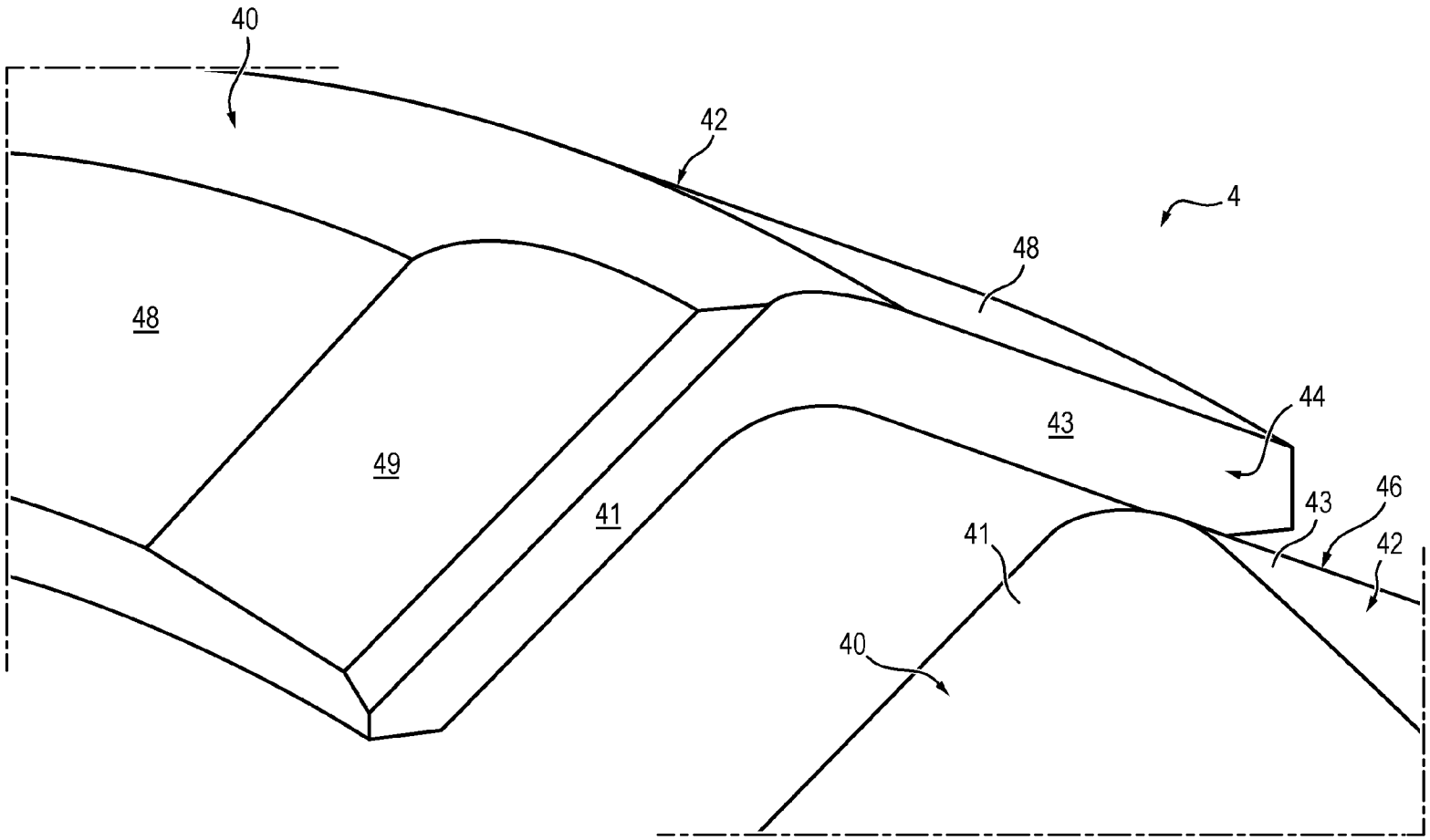
Figure 7:
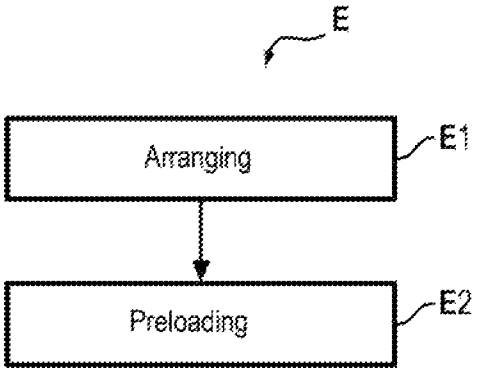
Figure 6:
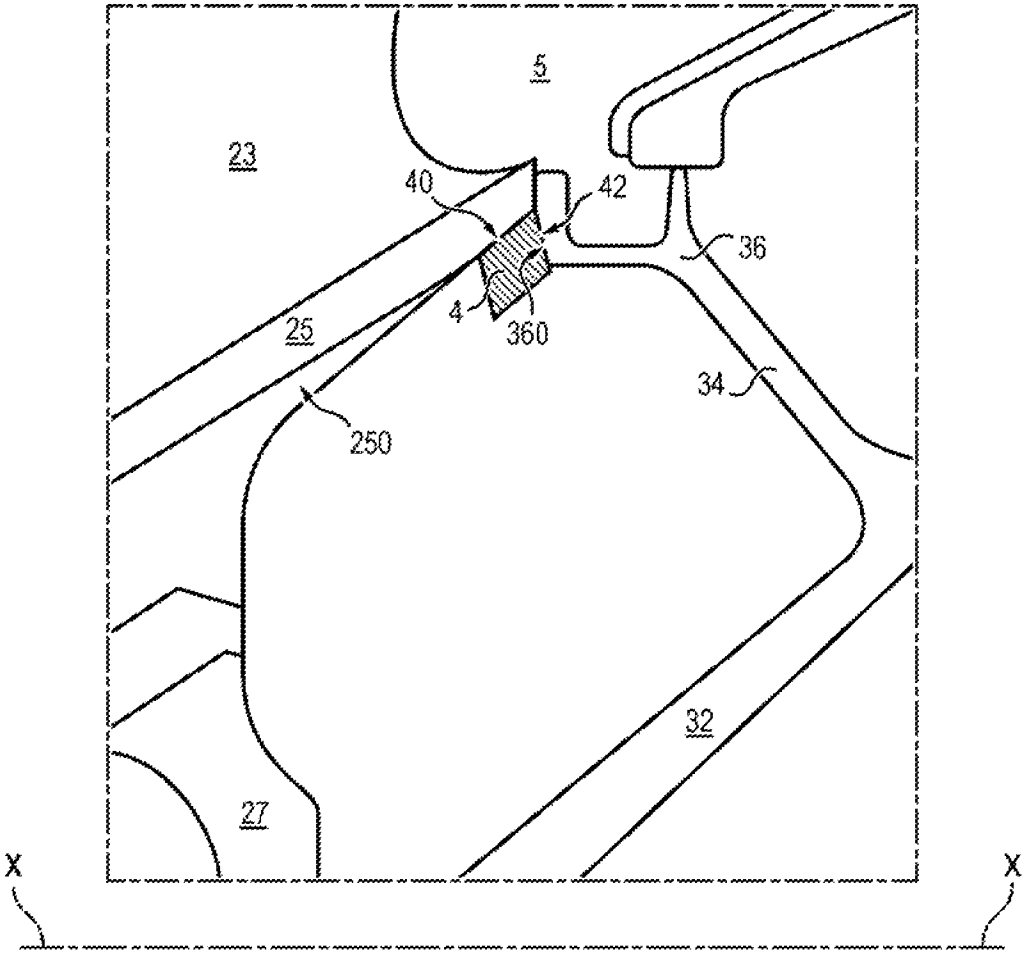

Other features, objects and advantages of the present invention will appear upon reading the detailed description that follows and with reference to the appended drawings given by way of nonlimiting examples and in which:

FIG. 1 is a schematic section view of an exemplary embodiment of the assembly according to the invention, FIG. 2 is a front view of a rotor module subjected to tangential vibrations the flexural mode of which has zero dephasing, FIG. 3*a* illustrates schematically tangential movements of the turbomachine rotor modules, as a function of the position of said modules along a turbomachine axis, FIG. 3*b* is an enlargement in schematic perspective of the interface between two turbomachine rotor modules illustrating its tangential movements relative to said rotor modules, FIG. 4 illustrates schematically a first exemplary embodiment of a damping device according to the invention, FIG. 5 illustrates schematically an enlargement of a second exemplary embodiment of a damping device according to the invention, FIG. 6 illustrates schematically a portion of another exemplary embodiment of an assembly according to the invention, and FIG. 7 is a flowchart detailing an exemplary embodiment of an assembly method according to the invention.

DETAILED DESCRIPTION OF THE INVENTION

An exemplary embodiment of an assembly 1 according to the invention will now be described, with reference to the figures.

Hereafter, upstream and downstream are defined with respect to the normal flow direction of air through the turbomachine. Furthermore, a turbomachine longitudinal axis X-X is defined. In this manner, the axial direction corresponds to the direction of the turbomachine longitudinal axis X-X, a radial direction is a direction which is perpendicular to this turbomachine longitudinal axis X-X and which passes through said turbomachine longitudinal axis X-X, and a circumferential direction corresponds to the direction of a closed planar curve, of which all points are located at equal distance from the turbomachine longitudinal axis X-X. Finally, and unless the contrary is stated, the terms "internal (or interior)" and "external (or exterior)" respectively, are used with reference to a radial direction so that the internal (i.e. radially internal) portion or face of an element is closer to the turbomachine longitudinal axis X-X than the external (i.e. radially external) portion or face of the same element.

Referring to FIGS. 1, and 3*a*, such an assembly 1 comprises:

- a first rotor module 2 comprising a first blade 20,
- a second rotor module 3, connected to the first rotor module 2, and comprising a second blade 30 with a length smaller than the first blade 20, and
- a damping device 4 which extends with at least one component along a turbomachine longitudinal axis X-X. In addition, the damping device 4 is annular while extending circumferentially around a turbomachine longitudinal axis X-X, and comprises a first radial external surface 40, supported with friction against the first module 2, as well as a second radial external surface 42 supported with friction against the second module 3, so as to couple the modules 2, 3 in order to damp their respective vibrational movements during operation.

By support "with friction" is meant that the contact between the radial external surfaces 41, 42 and, respectively, the first rotor module 2 and the second rotor module 3 occurs with friction. In other words, the support forces between the radial external surfaces 41, 42 and, respectively, the first rotor module 2 and the second rotor module 3 can be decomposed into pressure forces which are directed normal to the contact, and friction forces, directed tangentially to the contact. This support guarantees both the mechanical consistency of the assembly 1, by means of the pressure forces, but also the coupling between the modules 2, 3 in order to damp their respective vibrational movements during operation, by means of the friction forces.

Referring to FIGS. 1 and 3*a*, the first rotor module is a fan 2, and the second rotor module is a low-pressure compressor 3, situated immediately downstream of the fan 2.

The fan 2 and the low-pressure compressor 3 comprise a disk 21, 31 centered on a turbomachine longitudinal axis X-X, the first 20 and the second 30 blade being respectively mounted on the external periphery of the disk 21, 31 and further comprising an airfoil 23, 33, a platform 25, 35, a support 27, 37 and a root 29, 39 embedded in a recess 210, 310 of the disk 21, 31. The distance separating the root 29, 39 from the end of the airfoil 23, 33 constitutes the respective lengths of the first 20 and of the second 30 blade. The length of the first blade 20 and second blade 30 is therefore considered here to be substantially radial with respect to the longitudinal axis X-X of rotation of the rotor modules 2, 3. In operation, the blade 23, 33 is swept by a flow 5 passing through the turbomachine, and the platform 25, 35 forms a portion of the internal surface of the flow path 5. Generally, as can be seen in FIGS. 2 and 3*a*, the fan 2 and the low-pressure compressor 3 comprise a plurality of blades 20, 30 distributed circumferentially around the longitudinal axis X-X. The low-pressure compressor 3 further comprises an annular ferrule 32 also centered on the longitudinal axis X-X. The ferrule 32 comprises a circumferential extension 34, also annular, extending toward the platform 25 of the first blade 20. This annular extension 34 carries radial knife edge seals 36 configured to prevent air flow rate losses from the flow path 5. Moreover, the ferrule 32 is attached to the disk 21 of the fan 2 by means of attachments 22 distributed circumferentially around the longitudinal axis X-X. Such attachments can for example be bolted connections 22. Alternatively, such attachments 22 can be achieved by an interference fit to which is associated an anti rotation device and/or an axial locking system. Finally, with reference to FIG. 3*a*, the assembly formed from the fan 2 and the compressor 3 is rotated by a rotating shaft 6, called the low-pressure shaft, to which the fan 2 and the low-pressure compressor 3 are integrally connected, by means of a rotor trunnion 60, the low-pressure shaft 6 being also connected to a low-pressure turbine 7, downstream of the turbomachine, and extending along the turbomachine longitudinal axis X-X.

In operation, the fan 2 aspires air of which all or part is compressed by the low-pressure compressor 3. The compressed air then circulates in a high-pressure compressor (not shown) before being mixed with fuel, then ignited within the combustion chamber (not shown), to finally be successively expanded in the high-pressure turbine (not shown), and the low-pressure turbine 7. The opposite forces of compression, upstream and of expansion downstream cause aeroelastic flutter phenomena, which couple the aerodynamic forces on the blades 20, 30 and the flexural and torsional vibration movements in the blades 20, 30. As illustrated in FIG. 2, this flutter causes in particular intense torsional forces within the low-pressure shaft 6 which are fed through to the fan 2 and to the low-pressure compressor 3. The blades 20, 30 are then subjected to tangential pulses, particularly according to a vibration mode with zero dephasing. This is in fact a flexural mode with zero inter-blade 20, 30 dephasing, involving a non-zero moment on the low-pressure shaft 6, of which the natural frequency is approximately one and a half times greater than that of the first vibration harmonic, and of which the deformation has a nodal line at the half-height of the blade 20, 30. Such vibrations limit the mechanical performance of the fan 2 and of the low-pressure compressor 30, accelerate the wear of the turbomachine and reduce its lifetime.

As can be seen in FIG. 3*a*, the tangential movement by flutter of the fan 2 blade 20 is different from that of the ferrule 32 of the low-pressure compressor 3. Indeed, the length of the blade 20 of the fan 3 being greater than that of the low-pressure compressor 3 blade 30, the tangential flexural moment caused by the fan 2 blade 20 pulses is much greater than that caused by the low-pressure compressor 3 blade 30 pulses. In addition, the stiffness of mounting within the fan 2 is different from that of mounting within the compressor 3. With reference to FIG. 3*b*, this deviation in tangential pulses is particularly visible at the interface between the platform 25 of a fan 2 blade 20, and the ferrule 32 knife edge seals 36.

In a first embodiment with reference to FIG. 1, the damping device 4 is accommodated under the platform 25 of a fan 2 blade 20, between the root 27 and the low-pressure compressor 3 ferrule 32. In addition, the low-pressure compressor 3 comprises an annular attachment ferrule 38, shrink-fit to the circumferential extension 34 of the low-pressure compressor 3 ferrule 32. Alternatively, the attachment ferrule 38 can be assembled to the ferrule 32 circumferential extension 34 by means of attachments such as those provided by radial fingers (not shown) belonging to said attachment ferrule 38 and screwed to said extension 34.

Traditionally, the lips 36 comprise substantially radial sealing free ends to face a stator. Here, the lips 36 include an annular root which connects these ends to the ferrule 32 circumferential extension 34.

The first radial external surface 40 is supported with friction against the fan 2 at the internal surface 250 of the platform 25 of the fan 2 blade 20, and the second radial external surface 42 is supported with friction on the attachment ferrule 38. This ensures tangential coupling with high stiffness between the fan 2 and the low-pressure compressor 3, so as to reduce the tangential vibrations previously described. The coupling is in fact the greater as the zone in which the damping device 4 is disposed has the higher relative tangential movements for the zero-dephasing mode considered, as illustrated in FIGS. 3*a* and 3*b*. Typically, these relative displacements are on the order of a few millimeters. Furthermore, the damping device 4 also advantageously retains effectiveness on vibrational mode of the fan 2 blades 20 with non-zero dephasing.

In the embodiments illustrated in FIGS. 1, 4 and 5 the damping device 4 is an annular tab the cross section of which has the shape of a V. The radial external surface 40 of the first branch 41 of the V forming the first surface 40 supported with friction against the fan 2, the external surface 42 of the second branch 43 of the V forming the second radial external surface 42 supported with friction against the low-pressure compressor 3. The tab structure advantageously allows reducing the bulk of the damping device 4 within the assembly 1. In addition, the V shaped structure allows increasing the contact surface between the fan 2 and the damping device 4 on the one hand, and between the damping device 4 and the low-pressure compressor 3 on the other hand. This configuration therefore favor coupling between the two rotor elements, in order to damp their vibrational movements.

In order to facilitate assembly, the annular tab 4 does not consist of a single piece ring, but is split so as to define two ends 44, 46 facing one another.

The mechanical forces during operation are such that slight tangential, axial and radial movements of the damping device 4 should be expected. These movements are in particular due to the tangential pulses to be damped, but also the centrifugal loading of the assembly 1. It is necessary that these movements do not cause wear on the blades 20 or the ferrule 32, of which the coatings are relatively fragile. In this regard, the support surfaces 40, 42 of the damping device can be treated by dry lubrication, in order to maintain the value of the friction coefficient between the damping device 4 and the low-pressure compressor 3 and/or the blade 20 platform 25. This lubrication property is for example of the MoS2 type.

In order to improve the support with friction, the damping device 4 comprise, in a second embodiment, an additional coating 48, 49, as can be seen in FIG. 5, defining the support surfaces 40, 42. Generally, such a coating 48, 49 is configured to reduce the friction and/or the wear of the engine parts between the damping device 4 and the rotor modules 2, 3. This coating 48, 49 is for example of the dissipative 48 and/or viscoelastic and/or damping type. The dissipative coating 48 then comprises a material chosen from those having mechanical properties similar to those of Vespel, of Teflon or of any other material with lubricating properties. More generally, the material has a friction coefficient comprised between 0.3 and 0.07. Too high a flexibility would not allow the damping of the mode with zero dephasing, because the relative movements of the fan 2 and of the low-pressure compressor 3 would lead to friction and/or oscillations between a "stuck" state and a "slipping" state of the damping device 4. In addition, the frictional coating 48 constitutes an effective alternative to dry lubrication treatment, which must be implemented regularly.

Alternatively, this coating 48, 49 is of the viscoelastic type 49. Such a coating 49 then advantageously comprises a material having properties similar to those of a material like those of the range having the commercial designation of "SMACTANE®," for example a material of the "SMACTANE® 70" type. Another way of increasing the tangential stiffness of the assembly 1 is to sufficiently preload the viscoelastic coating 44, for example during assembly of the assembly 1, so that the relative tangential displacement between the blade 20 and the ferrule 32 is transformed into viscoelastic shear of the coating 44 alone.

These additional coatings 48, 49 are applied by gluing to the support surfaces 40, 42.

In an embodiment detail as illustrated in FIG. 4, damping by tangential coupling can be adjusted by controlling the mass of the damping device 4, which influences the shear inertia. This control involves modifications of the mass of the damping device 4. This mass can be modified in all or a part of the damping device 4, typically by making bores 45 to lighten it, and/or adding one or more inserts 47, metallic for example, to add weight. In addition, the control of the mass of the damping device 4 allows setting its effectiveness by means of the centrifugal forces that it undergoes during operation. This bore and/or insert embodiment detail can correspond to a third embodiment.

Advantageously, the combination of the second and the third embodiment allows adjusting the contact forces between the damping device 4 and the fan 2 and the low-pressure compressor 3. Indeed, contact forces that are too high between the fan 2 blade 20 and the damping device 4 would limit the dissipation of vibrations during operation.

In a fourth embodiment illustrated in FIG. 6, the damping device 4 is an annular cylinder, the cross section of which has the shape of a rhombus. The radial external surface 40 of a first side of the rhombus forming the first radial external surface 40 supported with friction against the fan 2, the radial external surface 42 of a second side of the rhombus forming the second radial external surface 42 supported with friction against the low-pressure compressor 3. The rhombus-shaped cross section is in fact denser than the V shaped section, which allows increasing mechanical coupling between the fan 2 and the low-pressure compressor 3, by favoring the tangential stiffness of the assembly 1.

In addition, the first radial external surface 40 is supported with friction against the fan 2 at the internal surface 250 of the platform 25 of the fan 2 blade 20, and the second radial external surface 42 is also supported with friction on the radial sealing lips 36. Advantageously, the support surfaces 40, 42 of the damping device 4, and the surfaces 250, 360 of the platform 25 and the radial sealing lips 36 are treated so as to guarantee their respective supports. More advantageously, the treatment consists of a carbon-carbon deposit which provides a strong friction coefficient, while limiting the wear of the surfaces 250, 360 of the platform 25 and of the radial sealing lips 36. This support with friction is on the root of the lips 36, i.e. at a distance from their sealing free ends.

In order to facilitate assembly, the cylinder 4 does not consist of a single piece ring, but is split so as to define two ends facing one another.

Advantageously, the damping device 4 comprises a dense material, preferably steel or a nickel-based alloy, so as to maximize the tangential stiffness of the coupling between the fan 2 and the low-pressure compressor 3.

Different embodiments of the assembly 1 according to the invention have been described in the case where the first rotor module 2 is a fan, and the second rotor module 3 is a low-pressure compressor.

This, however, is not limiting, because the first rotor module 2 can also be a first, high- or low-pressure, compressor stage, and the second rotor module 3 a second stage of said compressor, successive to the first compressor stage, upstream or downstream of the latter. Alternatively, the first rotor module 2 is a first, high- or low-pressure, turbine stage and the second rotor module 3 a second stage of said turbine, successive to the first turbine stage, upstream or downstream of the latter.

An assembly method for an assembly 1 according to any one of the embodiments previously described will now be detailed, with reference to FIG. 7.

During a first step E1, the damping device 4 is positioned between the first rotor module 2 and the second rotor module 3, so that a first external surface 40 of the damping device 4 is supported with friction against the first module 2, and that a second radial external surface 42 of the damping device 4 is supported with friction against the second module 3.

During a second step E2, the damping device 4 is preloaded against the first 2 and the second rotor module 3 so as to couple them in order to damp their respective vibrational movements during operation.

Such an assembly method E is advantageously favored by the simple nature resulting from the annular shape of the damping device 4. In fact, the damping device 4 is simply positioned within an assembly 1, already assembled, without necessitating the addition of fasteners, bolted for example, which would increase both the mass of the assembly 1, and its assembly and/or maintenance time.

The invention claimed is:

1. A turbomachine assembly comprising:

a first rotor module comprising a disk centered on a turbomachine longitudinal axis and a first blade mounted on an external periphery of the disk, the first blade thus extending from the external periphery of the disk, the first blade further comprising an airfoil, a platform, a support and a root, the root being embedded in a housing of the disk, the first blade having a first length;

a second rotor module connected to the first rotor module and comprising a second blade and a ferrule, the ferrule comprising a circumferential extension that extends toward the platform of the first blade, the second blade having a second length, the second length being smaller than the first length; and a damping device extending with at least one component along the turbomachine longitudinal axis, the damping device being annular while extending circumferentially around the turbomachine longitudinal axis, the damping device comprising a first radial external surface supported with friction against the first rotor module, the first radial external surface being supported with friction on a radially internal surface of the platform, as well as a second radial external surface supported with friction against the second rotor module, the second radial external surface being supported with friction on the ferrule, so as to couple the first rotor module with the second rotor module in order to damp vibrational movements of the first rotor module relative to the second rotor module during operation.

2. The turbomachine assembly of claim 1, wherein the damping device is an annular tab, a cross section of the damping device being shaped like a V, a first external surface of a first branch of the damping device forming the first radial external surface, a second external surface of a second branch of the damping device forming the second radial external surface.

3. The turbomachine assembly of claim 1, wherein an attachment ferrule is shrink-fit to the circumferential extension, the second radial external surface being supported with friction on the attachment ferrule.

4. The turbomachine assembly of claim 1, wherein the circumferential extension has radial sealing lips, the second radial external surface being supported with friction on the radial sealing lips.

5. The turbomachine assembly of claim 4, wherein the first radial external surface, the second radial external surface, the radially internal surface and surface of the radial sealing lips supporting the second radial external surface are treated so as to guarantee supports.

6. The turbomachine assembly of claim 1, wherein the damping device comprises bores intended to lighten the damping device.

7. The turbomachine assembly of claim 1, wherein the damping device comprises inserts intended to add weight to the damping device.

8. The turbomachine assembly of claim 1, wherein the first rotor module is a fan, and the second rotor module is a low—pressure compressor.

9. The turbomachine assembly of claim 1, wherein the damping device is split so as to define two ends facing one another.

10. A turbomachine comprising the turbomachine assembly of claim 1.

11. An assembly method, comprising:

positioning a damping device between a first rotor module and a second rotor module so that a first radial external surface of the damping device is supported with friction against the first rotor module and a second radial external surface of the damping device is supported with friction against the second rotor module, the first rotor module comprising disk centered on a turbomachine longitudinal axis and a first blade mounted on an external periphery of the disk, the first blade thus extending from the external periphery of the disk, the first blade further comprising an airfoil, a platform, a support and a root, the root being embedded in a housing of the disk, the first blade having a first length, the first radial external surface being supported with friction on a radially internal surface of the platform, the second rotor module being connected to the first rotor module and comprising a second blade and a ferrule, the ferrule comprising a circumferential extension extending toward the platform of the first blade, the second blade having a second length, the second length being smaller than the first length, the second radial external surface being supported with friction on the ferrule, the damping device extending with at least one component along the turbomachine longitudinal axis, the damping device being annular while extending circumferentially around the turbomachine longitudinal axis; and preloading the damping device against the first rotor module and the second rotor module, so as to couple the first rotor module with the second rotor module in order to damp vibrational movements of the first rotor module relative to the second rotor module during operation.

* * * * *